United States Patent [19]

Takeuchi

[11] 4,078,985

[45] Mar. 14, 1978

[54] HYDROGEN GENERATOR

[75] Inventor: Yukihisa Takeuchi, Aichi, Japan

[73] Assignee: Nippon Soken, Inc., Nishio, Japan

[21] Appl. No.: 743,491

[22] Filed: Nov. 19, 1976

[30] Foreign Application Priority Data

| | | |
|---|---|---|
| Nov. 21, 1975 | Japan | 50-140462 |
| Feb. 13, 1976 | Japan | 51-15042 |
| Mar. 3, 1976 | Japan | 51-22845 |
| Mar. 8, 1976 | Japan | 51-27365 |
| Jun. 25, 1976 | Japan | 51-84275 |
| Jul. 5, 1976 | Japan | 51-88990 |

[51] Int. Cl.[2] ..... C25B 15/02; C25B 1/12; C25B 9/00

[52] U.S. Cl. ..... 204/230; 204/129; 204/266; 204/278

[58] Field of Search ..... 204/129, 278, 230, 275–277, 204/266

[56] References Cited

U.S. PATENT DOCUMENTS

| | | | |
|---|---|---|---|
| 3,490,235 | 1/1970 | Grant | 204/278 X |
| 3,616,436 | 10/1971 | Haas | 204/229 |
| 3,755,128 | 8/1973 | Herwig | 204/230 |
| 3,796,647 | 3/1974 | Shalit | 204/129 X |
| 3,835,019 | 9/1974 | Lovelock | 204/246 |

*Primary Examiner*—John H. Mack
*Assistant Examiner*—D. R. Valentine
*Attorney, Agent, or Firm*—Cushman, Darby & Cushman

[57] ABSTRACT

This invention relates to a hydrogen generator for producing hydrogen gas by electrolyzing an electrolytic solution, mainly consisting of water in an electrolytic cell; wherein palladium or palladium alloy membranes are used as the cathode and hydrogen gas to be generated by electrolysis permeates the said cathode and is collected in a hydrogen chamber. This apparatus, including a pipe for discharging the oxygen to be released at the anode, the said pipe being provided with an oxygen gas valve, and a hydrogen gas supply pipe which is connected to a hydrogen chamber and is provided with a hydrogen gas valve, is characterized by that oxidation of the said cathode is prevented by sealing the said electrolytic cell and the said hydrogen chamber while this is not in operation.

34 Claims, 29 Drawing Figures

HYDROGEN GENERATOR

BRIEF SUMMARY OF THE INVENTION

The present invention relates to a hydrogen generator wherein hydrogen is produced, in the way of electrolysis, and purified by means of palladium or palladium alloy membranes forming a cathode, and particularly to a hydrogen generator used for a gas indicator utilizing the purified hydrogen gas as a carrier to detect unknown gases, or for a device utilizing the purified hydrogen gas as a fuel.

There has been a well-known device for producing high purity hydrogen gas, in which, using palladium or palladium alloy tube as a cathode, water is electrolysed to generate purified hydrogen gas. In such a well-known device, hydrogen gas liberated at the cathode is permeated through the wall of palladium tube, used as the cathode, having a wall thickness of about 150 $\mu$, simultaneous with pressurizing the hydrogen gas up to 5 to 8 atm.. The hydrogen generator is so constructed that the anode made of nickel forms the exterior of the electrolytic cell, and the paradium alloy cathode, in the cell, forms a hollow cylindrical tube opened at one end and closed at the other end, having a wall thickness of more than 100 $\mu$. Since the purified hydrogen gas permeated through the wall of the palladium tube, has relatively large capacity in comparison with its consumed capacity, the pressure of the purified gas naturally tends to be increased.

However, the above said well-known gas generator has following disadvantages:

The activated palladium cathode is oxidized into palladium oxide by oxygen which is released at the anode and dissolved in the electrolytic solution when the generation of the hydrogen is stopped, or by other oxygen which exsists in the atmosphere and also dissolves into the electrolytic solution. When the activated palladium or palladium alloy cathode is oxidized, the capacity of producing the purified hydrogen gas through the wall of palladium tube cathode, is remarkably lowered. In order to prevent the palladium or palladium alloy cathode from being oxidized, in the well-known hydrogen generator, by continuous energization between the cathode and the anode, the palladium or palladium alloy cathode should be held in the state that the cathode absorbes the hydrogen so enough to react on the oxygen dissolving in the electrolytic solution. But such continuous energization dissipates electrical power. Further, since the anode made of nickel forms the exterior or the outer casing of the electrolytic cell, the large amount of nickel material is required, which causes the hydrogen generator to be expensive. Whenever the hollow cylindrical tube made of palladium or palladium alloy material is used as the cathode arranged in the electrolytic solution, the cylindrical tube must have the wall thickness of about 150 $\mu$ from both economical and functional view points. To purify the hydrogen the thinner the wall thickness of the cylindrical tube, the better its capacity of producing the purified hydrogen through the wall of the tube. However, the proof-pressure of the tube is decreased, as the thickness of the tube wall is thined. It is to be noted that the proof pressure should be 5 to 8 atm.. Besides, it is difficult to make a uniform tube of less than 100 $\mu$ in wall thickness in practice. For these reasons described above, the wall of the tube should be greater than a predetermined value at the expense of its performance.

In view of the foregoing description, it is a general object of the present invention to provide a hydrogen generator with a novel feature which eliminates the above-mentioned disadvantages.

Another object of the present invention is to provide a hydrogen generator wherein the oxidation of the cathode can be prevented without an appreciable waste of electrical power.

A further object of the present invention is to provide a hydrogen generator wherein the cathode can be made thinner so as to improve its performance and its manufacturing cost. According to the embodiments of this invention, there are provided a hydrogen gas valve and an oxygen gas valve in the hydrogen supply passage and in the oxygen discharge passage, respectively, and the hydrogen valve is closed when the power supply is cut off for the cessation of the electrolysis and the oxygen gas valve is closed after a predetermined time lapses from the time when the power supply is turned off. The oxidation of the cathode without a waste of electric power is attained by so devising that the hydrogen gas is diffused back through the cathode into the electrolytic solution. With the construction wherein a pair of cathodes consisting of a pair of palladium or palladium alloy membranes, each made in the form of a plate are positioned in such a way that a pair of membranes face each other, and a pair of anode, each made in the form of a plate are placed between the said pair of cathode membranes, it becomes not technically difficult to make a cathode having a uniform thickness in comparison with the form of the hollow cylindrical tube. As the cathode can be made thin in this way, the material required is smaller and the performance in hydrogen permeability is greater. And as the result, a low-cost high efficiency hydrogen generator can be provided.

BRIEF DESCRIPTION OF THE SEVERAL VIEWS OF THE DRAWING

FIG. 3A through FIG. 9A are schematic views showing reinforcement plates.

FIG. 3B through FIG. 9B are sectional views thereof taken along the lines in the respective views mentioned above.

DETAILED DESCRIPTION

Figure 1:
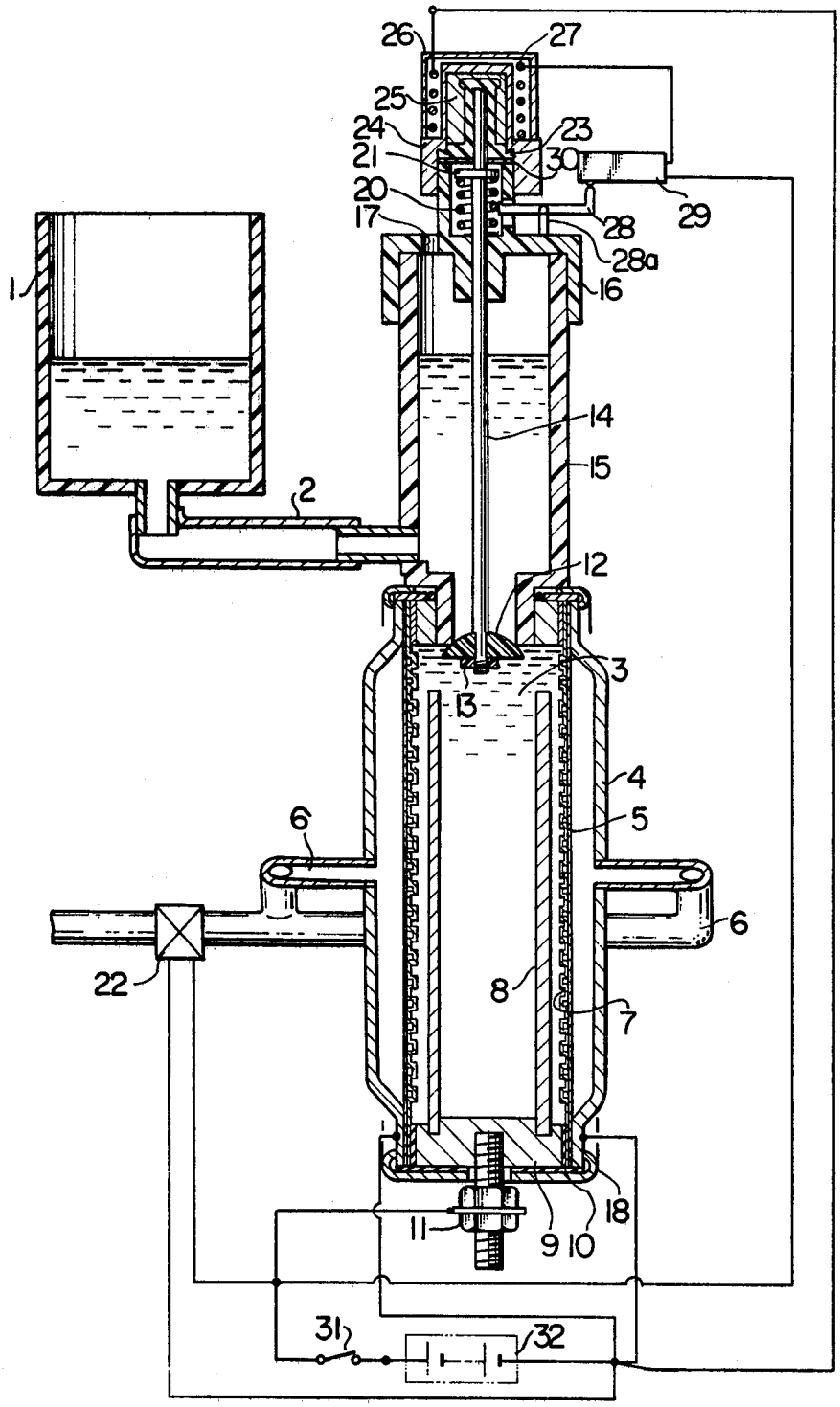
FIG. 1 is a schematic sectional view showing the structure of the first embodiment of the present invention.

The present invention will be explained in detail with reference to the embodiments illustrated in the drawings. In the first embodiment shown in FIG. 1, storage tank 1 for storing electrolytic solution is made of a plastics such as polyvinyl chloride and is connected to the main hydrogen generator with a connecting pipe 2, through which electrolytic solution is supplied to the generator. The electrolytic solution is pure water (distilled water) to which 20% by weight NaOH is added for adjustment. It may be adjusted by KOH or a high purity NaCl as well.

A case plate 4 in the main structure is of a disk shape or a round dish shape and is made of stainless steel. A pair of case plates 4 are positioned on the sides of a stainless steel ring 9 to make up a cylindrical body (its axis extends in the horizontal direction in FIG. 1).

Figure 2:
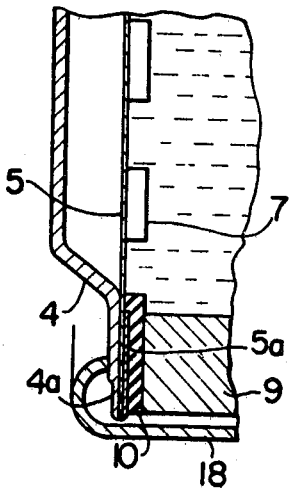
FIG. 2 is a partial sectional view showing an alternative means for joining the case plate to the cathode.
Figure 10:
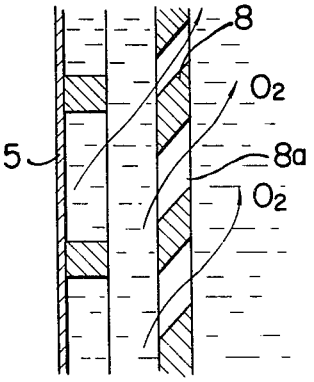
FIG. 10 is a partial enlarged view illustrating a modification of the anode.

A cathode 5 consists of a pair of hydrogen permeative palladium or palladium alloy flat membranes, each welded to inside of the respective case plate 4, and positioned in such a way that they face each other in the cylindrical body. It is preferable that the areas of those portions of the cathode 5 and anode 8 facing each other are substantially equal and the respective gap between the cathode 5 and anode 8 are made also substantially the same. It is also desirable that the anode 8 may have a plurality of slant holes 8a as shown in FIG. 10 for better discharge of oxygen gas to be produced on the surfaces of the anode 8. In order to obtain rigid welding of the cathode 5 to the case plate 4, the cathode 5 is held between the case plate 4 which is made thinner at its edge 4*a* and a reinforcement ring 5*a* made of the same material as the case plate 4 as shown in FIG. 2. The less difference between the thicknesses of the edge 4*a* and the reinforcement ring 5*a* the better the welding rigidity. A pair of membranes of the cathode 5 together with the ring 9 define a electrolytic cell 3 to be filled with electrolytic solution. The each cathode 5 also defines a hydrogen chamber together with the corresponding case plate 4. When a palladium alloy is used as the cathode 5, its composition may be approximately 30% palladium and the balance being made of any one or a mixture of two or more elements selected from the group consisting of copper, silver, gold, platinum and rhodium.

The cathode 5 can be made as thin as 2 - 100 microns because it was made flat. With a thickness of less than 2 microns, however, it was found to be unable to withstand 5 - 8 atm. pressure which is subjected at the time of producing purified hydrogen.

Figure 3A:
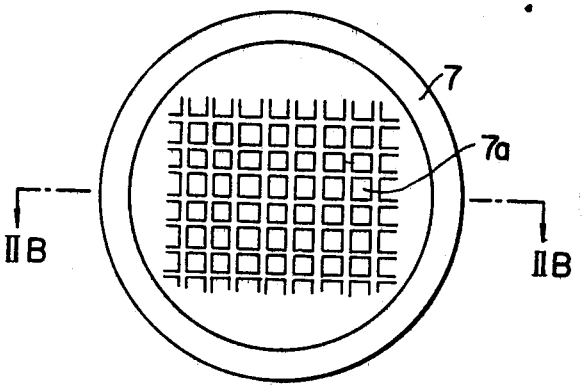
Figure 4A:
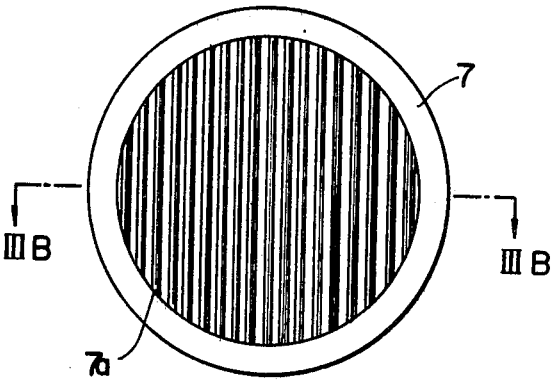
Figure 3B:
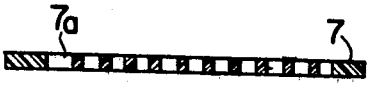
Figure 4B:
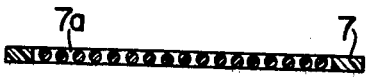
Figure 5A:
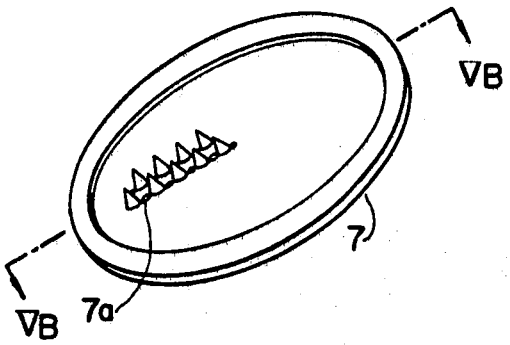
Figure 6A:
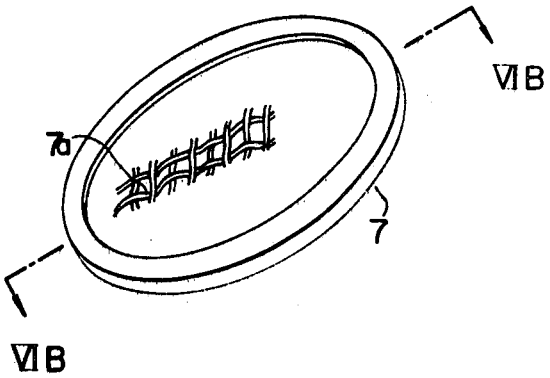
Figure 5B:
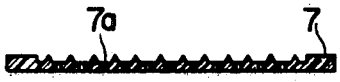
Figure 6B:
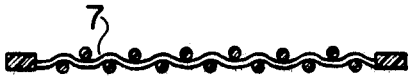
Figure 7A:
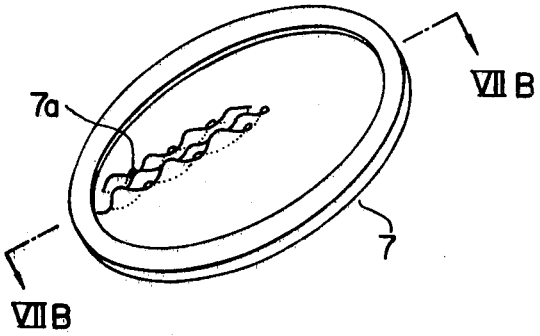
Figure 7B:
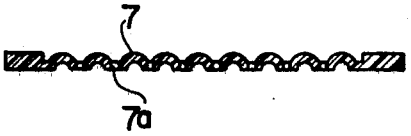
Figure 8A:
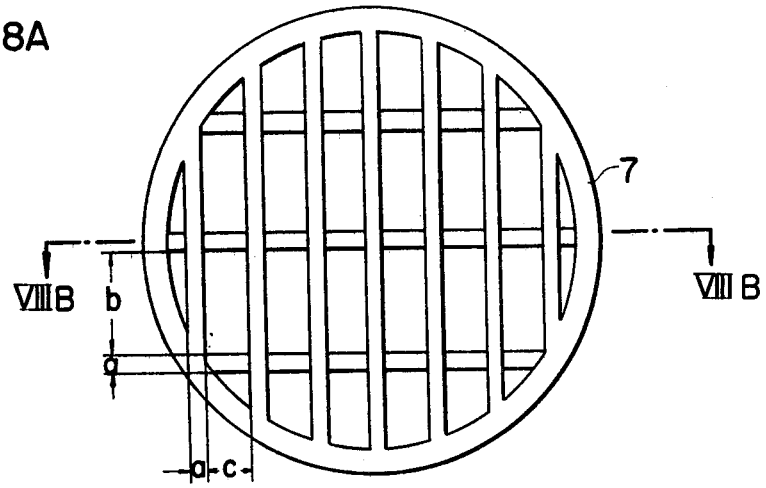
Figure 8B:
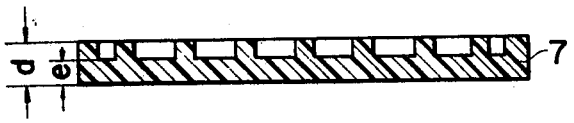
Figure 9A:
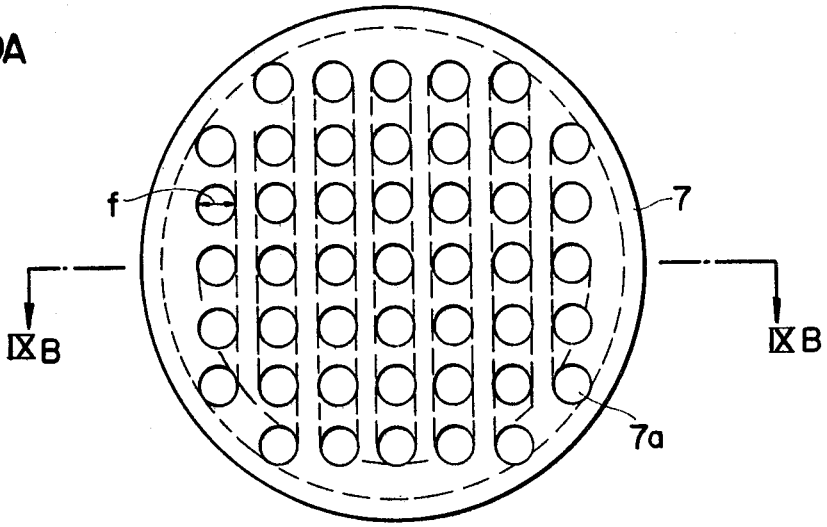
Figure 9B:
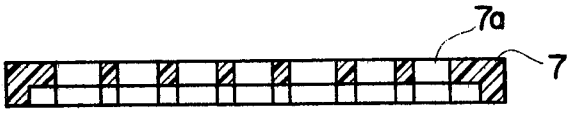

Supply pipes 6, fixed and connected to both sides of case plates 4 guide the hydrogen gas that has been produced through the cathode 5. Provided on the internal surface of the cathode 5 is a reinforcement 7 which can allow passage of electrolytic solution and hydrogen gas. This reinforcement 7 is for the protection of the cathode 5 from the pressure on it during the produce of the purified hydrogen. With the use of reinforcement 7, the thickness of cathode 5 may be further reduced. The reinforcements 7 which define the side surface of electrolytic solution are held between cathode 5 and insulator 10. The reinforcement 7 should be made of a material impurities of which are not dissolved into the solution when they deteriorated during the electrolysis of water such as polyacetal, polytetrafluoroethylene, polyester, etc. When the cathode 5 is more than 30 micron in thickness, the reinforcement 7 is required at least on the side of electrolytic solution or the inside surface but when it is less than 30 micron, an additional reinforcement (not shown in the drawing) is required on the side of the hydrogen chamber, that is at the outside surface thereof too. The reinforcement 7 may be made in various forms: a lattice-work as shown in FIG. 3A and FIG. 3B, a striped grating as shown in FIG. 4A and FIG. 4B, a form having spinous protrusions as shown in FIG. 5A and FIG. 5B, a network as shown in FIG. 6A and FIG. 6B and complex waves as shown in FIG. 7A and FIG. 7B. They all have a round frame and through-holes. Further, as shown in FIG. 8A and 8B, a double-decked lattice-work in which the thickness of horizontal strips differ from that of vertical stripping preferable. It is preferable, for various reasons, for example, for utilizing as much surface area as possible of the cathode 5 and keeping the distance between the cathode 5 and the anode 8 substantially constant, etc., that the width $a$ of the lattice strip is more than 1 mm, the distance $b$ plus $c$ is 2 mm $\leqq b + c \leqq$ 80 mm, the thickness $d$ 5 mm or less and the thickness $e$ 1 — 3 mm. A double-steps construction which has a plurality of round shaped through-holes 7*a* as shown in FIG. 9A and FIG. 9B may be also used. Here the diameter $f$ should preferably be 1 mm $\leqq f \leqq$ 35 mm. Metal rods may be used as a core material. These rods may be covered with polytetrafluoroethylene or polyvinyl dichloride and fixed to the round shape frame of plastics. In this case, the thickness of the coating may preferably be more than 10 micron. Metal lattice-works or nettings may also be used instead of metal rods.

Figure 11:
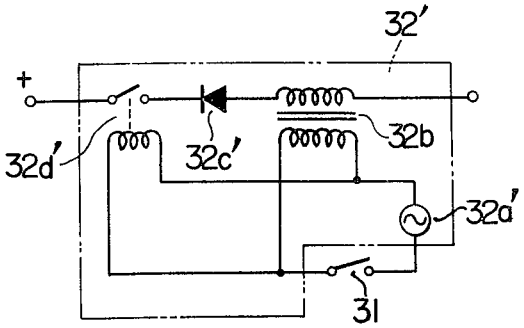
FIG. 11 is a partial enlarged view showing a modification of the power supply.

Coming back to FIG. 1, the cathodes 8 consist of a pair of nickel membranes in the form of a disk which are so positioned that they face each other in the electrolytic cell and are welded to the stainless steel ring 9. 10 is a ring-shaped insulator made of a plastics material such as polyethylene, polyester, P.T.F.E., etc. The case plate 4 and ring 9 fixed with cathode 5, while holding the edge of the reinforcement 7 and insulator 10 between them are fastened by the cylindrical ring 18 from outside. A terminal 11 which is connected to the plus terminal of a D.C. power supply 32 via a power supply switch 31 is screwed into the ring 9 for applying a voltage to the anode 8. The minus terminal of the power supply 32 is connected to the case plate 4 for applying voltage to the cathode 5. As for the D.C. power supply, as shown in FIG. 11 the household or industrial A.C. power supply 32*a*′ transformed down to 2 - 2.5 volts by an A.C. transformer 32*b*′ and rectified by a diode 32*c*′ may serves the purpose.

Here, when the primary circuit including the power supply 32*a*′ is cut off by the power supply switch 31, the secondary circuit including the diode 32*c*′ should also be disconnected with a relay 32*c*′.

Next, an oxygen gas valve for discharging oxygen gas will be explained. In the top portion of the ring 9 is provided a hole for oxygen discharge, and into this hole a pipe 15 made of P.V.C. for the passage of escaping oxygen is inserted. A plastics valve 12 is disposed at the lower end of pipe 15 and is fixed to a shaft 14 with a nut 13. The pipe 15, being connected with the aforementioned connecting pipe 2, also serves as the electrolytic solution supply passage. Over the top of the pipe 15 is put a plastics cap 16 provided with an oxygen discharge outlet 17 for discharging the oxygen gas into the atmosphere and with a bearing for the shaft 14 in the central portion. A valve drive unit for driving the oxygen gas valve is provided in the upper portion of the cap 16. In the valve drive unit is a coil spring 20 which is disposed between the cap 16 and the flange 21 of the shaft 14 and gives a biasing force to close the valve 12. A rubber sleeve 23 is fitted over the top end of the shaft 14. The space between this sleeve 23 and case 24 is filled with a wax 25 which changes in volume with temperature. A nichrome wire 27 for heating the wax 25 is wound around the case 24 and is covered with the case 26. It has a limit switch 29 which is operated by the flange 21 through an L-shaped lever 28 when the shaft 14 is moved beyond a predetermined stroke. The lever 28 is supported by a fulcrum 28a disposed on the cap 16. Although not shown in the figure, it is a good practice to place an insulating material such as ceramic wool between the nichrome wire 27 and the case 26 and to seal the nichrome wire 27 with a protective tube made of polytetrafluoroethylene, silicone rubber or other material for the prevention of hydrogen explosion. The nichrome wire 27 is connected to the power supply 32 via the power supply switch 31 and limit switch 29 and is fed with electrical current when both switches 2 and 31 are turned on. A stay 30 disposed between the sleeve 23 and the flange 21 is for the support of sleeve 23. A hydrogen valve 22 provided in the supply pipe 6 is an ordinary electromagnetic valve which opens when the power supply switch is on, and closes when the switch is off.

The position of the hydrogen gas valve 22 should be determined as follows:

Let V cc be the volume combining the volume of the hydrogen chamber, defined between the case 4 and the pair of cathodes 5, and that of the supply pipe 6 from the hydrogen chamber to the hydrogen gas valve; and let S $cm^2$ be the total surface area of the pair of the cathodes 5, the ratio $V/S = 0.35\ cc/cm^2$.

This is for attaining an effective prevention, to be described later, of the cathode from oxidation.

Now the mode of operation of the apparatus having the above-mentioned structure is explained in detail. When the power supply switch 31 is turned on and electricity is applied to the cathode 5 and the anode 8, for electrolysing the solution filled in the cylindrical body inside the cathode 5 oxygen gas is released at the anode 8 and hydrogen gas is produced at the cathode 5. Upon switching on the power supply switch 31, the electrical current is also sent to hydrogen gas valve 22 which immediately opens, and to the nichrome wire 27 for the operation of the oxygen gas valve. The oxygen gas valve is operated as follows. When the thermowax 25 is heated by the nichrome wire 27, it expands and moves the sleeve 23. The movement of the sleeve 23 is transmitted through the stay 30 to the shaft 14 and pushes down the valve 12 and as the result the oxygen gas valve opens. When the shaft 14 has travelled in a certain stroke, the flange 21 turns the lever 28 which in turn pushes of the limit switch 29 and the power supply to the nichrome wire 27 is cut off. As the thermowax 25 cools off, the shaft 14 is pushed back by the coil spring 20 by a little stroke upon which the limit switch 29 is turned on through the lever 28 and the power is supplied to the nichrome wire 27 again to repeat the shaft motion. The motion continues as long as the power is supplied to the cathode 5 and anode 8, in other words, it is repeated during the electrolysis of the solution, but since the valve itself moves only by a slightly partial stroke, the communication of the pipe 15 and cylindrical body is normally maintained. As the hydrogen gas valve 22 and the oxygen gas valve are open during the electrolysis of the solution, the oxygen comes through a gap or clearance between the valve 12 and the pipe 15 up the pipe and goes out into the atmosphere through the discharge outlet 17. On the other hand, the hydrogen permeates the cathode 5 and refines into a high-pressure high purity hydrogen which is fed through the pipe 6 to a suitable device where it is required. Upon switching off the power supply switch 31 to cut off the power supply to the cathode 5 and the anode 8, the hydrogen gas valve is closed concurrently and the power to the nichrome wire 27 is also cut off. The oxygen gas valve 12, however, remains opened till the thermowax 25 which has been heated with the nichrome wire 27 cools off. Therefore, the oxygen gas valve is closed after the lapse of a predetermined time. In this way it is so deviced that the hydrogen gas valve 22 closes the hydrogen supply pipe 6 concurrently with the cease of the electrolysis of the solution and the oxygen gas valve closes the passage for the escaping oxygen a little while later than the time of the cease. The hydrogen in the supply pipe 6, therefore, diffuses back through the cathode 5 into the electrolytic solution and keeps the cathode 5 in the state of occluding hydrogen. Thus, the inverse diffusion of the hydrogen into the electrolytic solution increases the pressure inside the cathode 5 (on the part of the electrolytic solution) and gradually eliminates the pressure differential, thereby bringing it to an equilibrium. Under this equilibrium, the hydrogen that has diffused back and the oxygen existing in the electrolytic solution in part react to form water. This reaction destroys the above-mentioned equilibrium and the hydrogen in the supply pipe resumes the inverse diffusion through the cathode 5 into the electrolytic solution to produce a new equilibrium. The repitition of this process gradually reduces the oxygen in the electrolytic solution into water. The amount of reaction of oxygen and hydrogen at the surface of the cathode 5 decreases as the temperature of the electrolytic solution decreases. Even if there remains oxygen that has not reacted upon hydrogen in the electrolytic solution under room temperature, the oxidation of the cathode 5, i.e., the palladium membranes, hardly occurs due to the fact that the cathodes 5 always occludes hydrogen and that the speed of reaction between oxygen and the cathode 5 is very slow at room temperature. Besides, the greater part of oxygen in the electrolytic solution goes out into the atmosphere before the oxygen gas valve is closed because of the fact that the oxygen gas valve remains opened for a while after the closing of the hydrogen gas valve 22 and further the inverse diffusion of the hydrogen in the supply pipe 6 through the cathode 5 into the electrolytic solution helps discharging the oxygen into the atmosphere, and as the result, there remains only a very little oxygen dissolved in the electrolytic solution in the cylindrical body 3 when the oxygen gas valve has been closed. For instance, according to an experiment in which the oxygen gas valve 22 was set to close 5 – 10 minutes after the switch 31 was turned off, and the hydrogen in the supply pipe 6 between hydrogen gas valve 22 and the cathode 5 had a pressure of 4 atm. and a volume of 50 cc, the amount of oxygen dissolved in the electrolytic solution, at the temperature of 80° C, was reduced from 1.6 – 1.8 cc oxygen per 100 cc electrolytic solution to 0.6 – 0.8 cc oxygen per 100 cc electrolytic solution. The pressure of the hydrogen in the supply pipe 6 between the hydrogen gas valve and the cathode 5 was down to 1.5 – 2 atm. after the lapse of 5 – 10 minutes. When the oxygen gas valve 12 was closed after the lapse of 5 – 10 minutes, its pressure was maintained at 1.0 – 1.5 atm. and the pressure of electrolytic solution, on the other hand, being approximately 1.0 atm., the cathode 5 was kept in the state of occluding hydrogen.

Here the desirable opening and closing time of oxygen gas valve will be described below. Unless the oxygen gas valve is opened within 60 seconds after the power supply switch has been turned on, the oxygen produced by the electrolysis and enclosed in the chamber defined within the cathode 5 in the cylindrical body adversely raises the pressure on the cathode 5 to 1.5 atm. approximately and damages the cathode 5. If the oxygen gas valve closes within 5 minutes after the power supply switch has been turned off, the oxygen produced at the anode 8 can not be sufficiently discharged and if it does not close after a lapse of 10 minutes, the temperature of the electrolytic solution that has been relatively high (70° – 80° C) is cooled down by more than 10° C and the amount of the oxygen dissolved in the electrolytic solution becomes greater than that decided in Henry's law and as the result the cathode 5 is oxidized. For the above reasons, the oxygen gas valve should open with 60 seconds after the start of the operation (after the power supply switch 31 has been turned on) and should close during the time between 5 – 10 minutes after the operation of the apparatus is stopped (after the turn-off of the power supply switch 31).

In order to satisfy the above-mentioned condition, though this depends on other conditions such as the electric consumption of the nichrome wire, amount of wax and the amount of electrolytic solution, a thermowax changing from a solid form to a liquid form at the temperature of 100° C – 10° C should be selected for economical and practical reasons.

Figure 12:
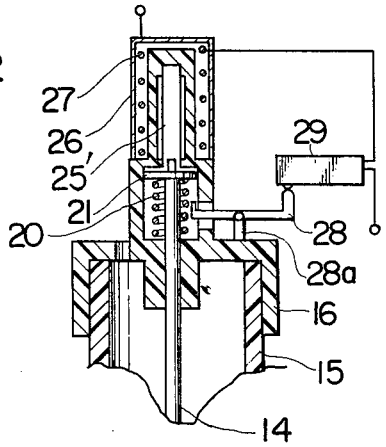
FIG. 12 through FIG. 16 are schematic views showing modifications of oxygen gas valves.
Figure 13:
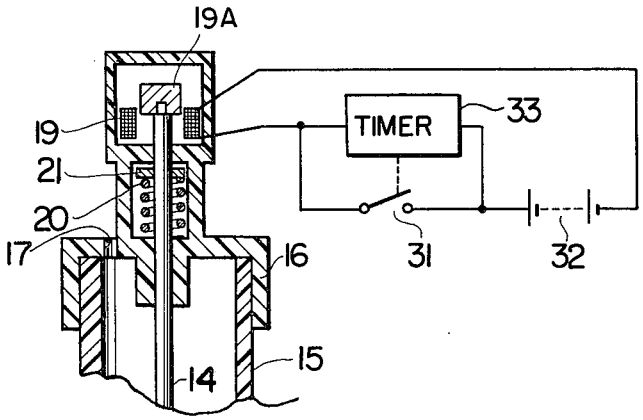

The thermowax used here in this embodiment mainly consists of an ester of fat acids and insoluble high class monohydric or dihydric alcoholes and an ester of a fat acids and glycerin. A wax mainly consisting of montan wax and a hydrocarbon, ozocerite occuring independently in nature or a petroleum wax such as paraffin wax, microcrystalline wax, petrolatum wax, etc. can also be used for it. Instead of one kind of wax, a mixture of two or more types of wax can be used as well. Whichever wax it may be, the lowest temperature at which it starts changing from a solid form to a liquid form must be within 100° C – 40° C. Also as shown in FIG. 12, a heat-sensitive member 25' consisting of a metal which has a high coefficient of thermal expansion may be used instead of wax 25 to drive the oxygen gas valve. The drive unit for the oxygen gas valve may be also so constructed as shown in FIG. 13 that the D.C. power supply 32 continues to send electrical current to an electromagnetic coil 19 after the turn-off of the power supply switch 31 and the closed circuit of the D.C. power supply and the electromagnetic coil 18 is opened (deenergized) by a timer 33 after the lapse of a predetermined time (for instance, 5 – 10 minutes) so that an iron core 19A in association with the coil 19 closes the oxygen gas valve through the shaft 14 by the spring 20. Whenever lowering, more or less, in performance of oxygen gas discharge is allowed, the oxygen gas valve may be operated concurrently with the on-off of the power supply switch 31, by eliminating the timer.

Figure 14:
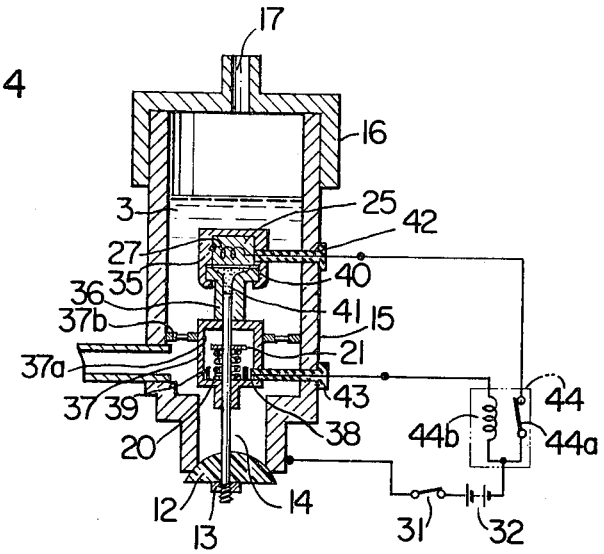
Figure 15:
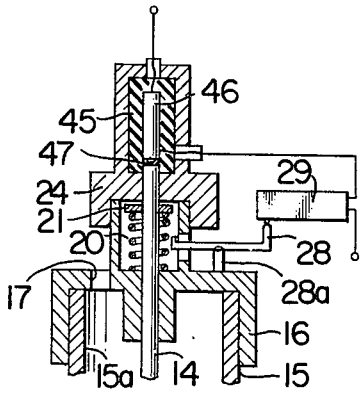
Figure 16:
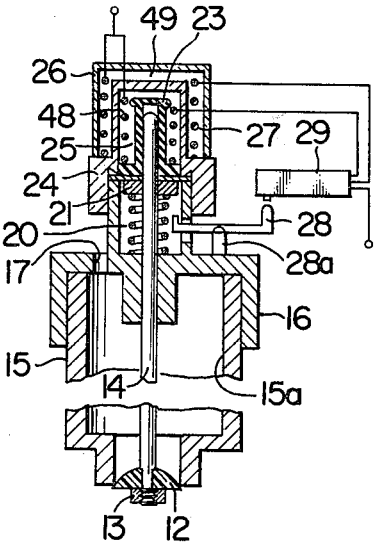

FIG. 14 which shows another example of its modification will be explained. A case 35 made of a metal having very high thermal conductivity is disposed in the electrolytic solution 3. The case 35 encloses a wax 25 in which a nichrome wire 27 is embedded. A metallic guide case 36 for guiding a shaft 14 is fixed to a metallic case 37 which forms a chamber **37*a*. The case 37 which is supported to a metal case 125 with a metallic plate 37*b* having holes. A tip of a metallic wire 38 is exposed in the case 37 and is prevented from contacting a coil spring 20 by an annular insulator 39 provided in the case 37. 40 is a diaphragm which seals the wax 25 against a mediam 41 made of a semi-fluid material. 42 is an insulator insulating the nichrome wire 27 from the case 25. 43 is also an insulator insulating the metallic wire 3 from the case 15. 44 is a relay which controls the circuit including the power supply and the nichrome wire 27. When the power supply switch 31 is switched-on to feed the electrical current to the cathode 5, anode 8 and hydrogen gas valve, a circuit consisting of power supply 32, nichrome wire 27, case 35, guide case 36, case 37, plate 37*b* and case 15, is established via contact 44*a* of the relay 44, and the nichrome wire 27 generates heat which makes the wax 25 expands. The expansion of the wax 25 moves the shaft 14 to open the oxygen gas valve 12. As the shaft 14 moves, the flange 21 comes in contact with the tip of the metallic wire 38, establishing a closed circuit consisting of power supply 32, exciting coil 44b of relay 44, metallic wire 38, flange 21, coil spring 20, case 37, plate 37*b*, and case 15. Then the exciting coil 44*b* puts off the contact 44*a* and cuts the power supply to the nichrome wire 27. When the nichrome wire 27 is cooled and the shaft 14 is pushed backed by the spring force of the coil spring 20, the flange 21 comes off the metallic wire 38 and puts on the contact 44*a* of the relay 44 and the nichrome wire 27 is re-energized. This electrical on-off control for the nichrome wire 27 is repeated during the electrolytic operation, but the off-period of heating is such a short time that the valve 12 moves only by a small partial stroke and therefore the oxygen gas valve is kept opened. When the power supply switch 31 is turned off, the power supply to the nichrome wire 27 is cut off. And as the wax 25 cools down, the oxygen gas valve gradually closes. In this example, the wax 25 is directly heated by the nichrome wire 27 and at the same time so devices as to be warmed by the electrolytic solution. This shortens the time required for the opening of the valve at the start of the electrolysis, thereby preventing the cathode 5 from being damaged by the oxygen to be generated at the anode 8 which would otherwise remain undischarged. FIG. 15 shows a further example in which a metallic case 24 contains a nichrome bar 46 fit in an insulation tube 45 and the end of the nichrome bar 46 is made into contact with the shaft 14 via an insulating plate 47 made of, for example, ceramic material which would not break under the compressive force, and is connected to the power supply via a limit switch 29. This nichrome bar 46 expands as it heats itself and the expansion is transmitted to the shaft 14. In this example too, the opening time required for the oxygen gas valve is decided in a similar way as described above. A still further example is shown in FIG. 16, which will be explained below. The top end of the shaft 14 is fitted over with a rubber sleeve 23. The space between the sleeve 23 and the case 24 is filled with wax 25 in which a nichrome wire 48 is buried. A nichrome wire 27 is wound around the case 24 and is protected by a heat-insulating material. The control of the electric power to the both nichrome wires 27 and 48 is done by a limit switch 29. When the power supply switch 31 shown in the FIG. 1 is turned on, the power is fed via the limit switch 29 to the nichrome wires 27, 48, and the wax 25 expands in a very short time period and opens the oxygen gas valve. When the oxygen gas valve has opened to a certain extent, allowing the oxygen which has been liberated by the electrolysis to go out into the atmosphere, the flange 21 of shaft 14 pushes the lever 28 which in turn actuates the limit switch 29 to cut of the power supply to the nichrome wire 48. The power to the nichrome wire 27, however, is still maintained and the shaft is further pushed down until the gap between the valve 12 and the case 15 becomes sufficiently wider, for instance, 5 - 6 mm, so as to discharge the further amount of the oxygen into the atmosphere. At this point, the lever 28 is pushed again and the limit switch 29 breaks the circuit. As the wax cools down, the shaft 14 is pushed back by the spring force of the coil spring 20. When the gap between the valve 12 and the case 15 become smaller than the above-mentioned 5 - 6 mm, the limit switch 29 is operated via the lever 28 and closes the circuit to the nichrome wire 27. When the power supply switch 31 is turned off, the power supply to the nichrome wires 27 and 48 is broken and the wax 25 starts to cool. After the lapse of a short time, the valve 12 closes tightly against the case 15**.

Figure 17:
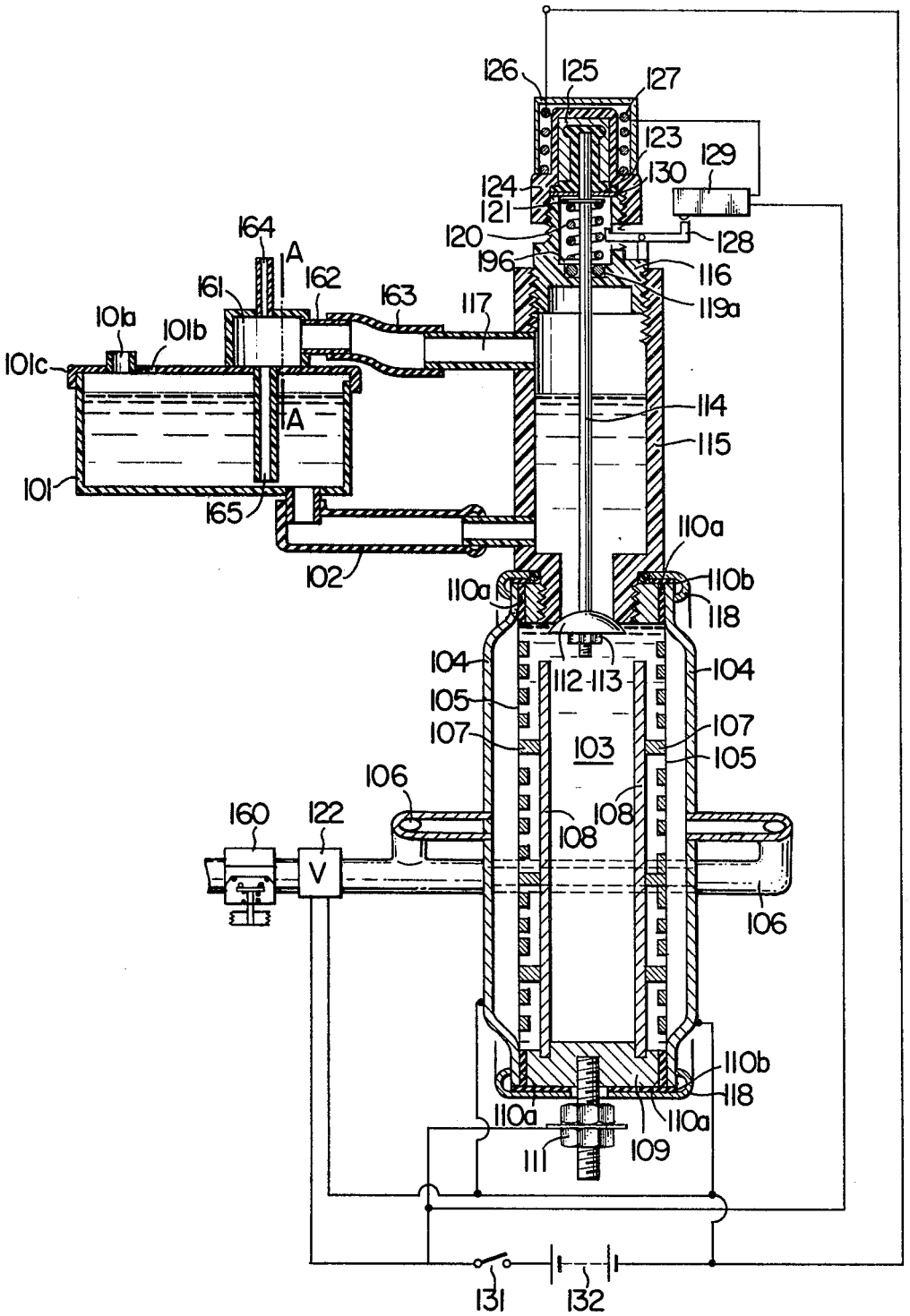
FIG. 17 is a schematic view showing the all-over structure of the second embodiment in accordance with this invention.

Next the second embodiment in accordance with this invention will be explained with main emphasis on the points which differs from the first embodiment shown in FIG. 1. In FIG. 17, two pieces of case plates 104 and a ring 109, being insulated by a pair of insulating plates 110*a* and an insulating ring 110*b*, are fastened together by means of a cylindrical case 118. A part of the latticework of the reinforcement plate 107 supporting the cathode 105 is made thicker so that it may contact the anode 108 and keep the distance between the cathode 105 and the anode 108 substantially constant.

A storage tank 101 is covered with a cup 101*c* having a solution supply hole 101*a* and an air vent hole 101*b*. The cap 101*c* is provided with an air bubble vanishing chamber 161. This bubble vanishing chamber is for making disappear the bubbles which accompanys with the oxygen gas to be discharged into the open air. The inlet 162 to the chamber is connected with a pipe 163 to oxygen discharge pipe 117. The bubble vanishing chamber 161 has a release pipe 164 for releasing oxygen to the atmosphere and a return pipe 165 for returning the vaper which has condensed in the passage from oxygen discharge pipe 117 to the bubble vanishing chamber 161. The bubble vanishing chamber 161 is so made that the sectional area at Sec. A—A is larger than that of the inlet 162 and the volume is less than 200 cc.

Figure 18:
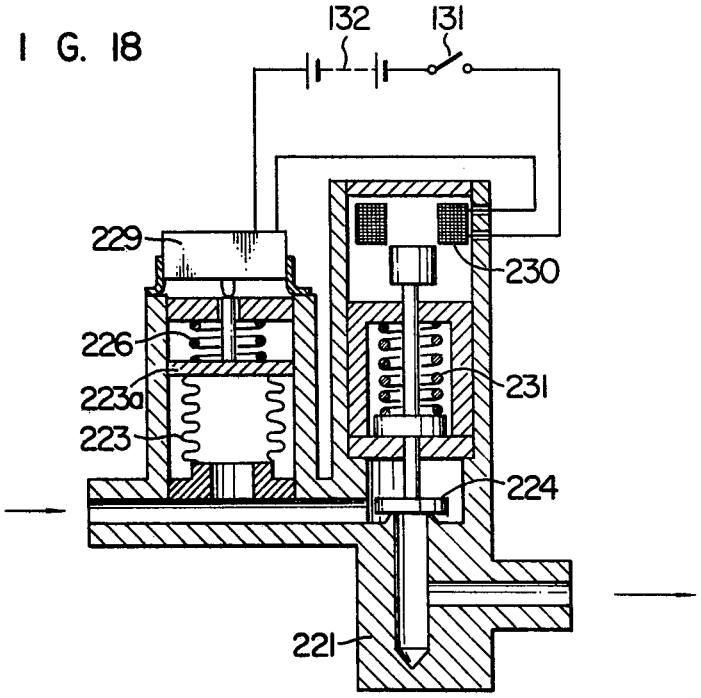
FIG. 18 is a schematic view showing the structure of a hydrogen gas valve.

As for the hydrogen gas valve 122, the pressure of the hydrogen gas is utilized for the control of the electromagnetic valve (See FIG. 18). The pressure of the hydrogen gas is detected with the expansion and contraction of a bellows 223. The expansion and contraction of this bellows operates a microswitch 229 via a plate 223a having a protrusion. The on and off of the microswitch, in addition to the on and off of the power supply switch, controls the power supply to the electromagnetic coil 230 and operates the electromagnetic valve 224.

Figure 19:
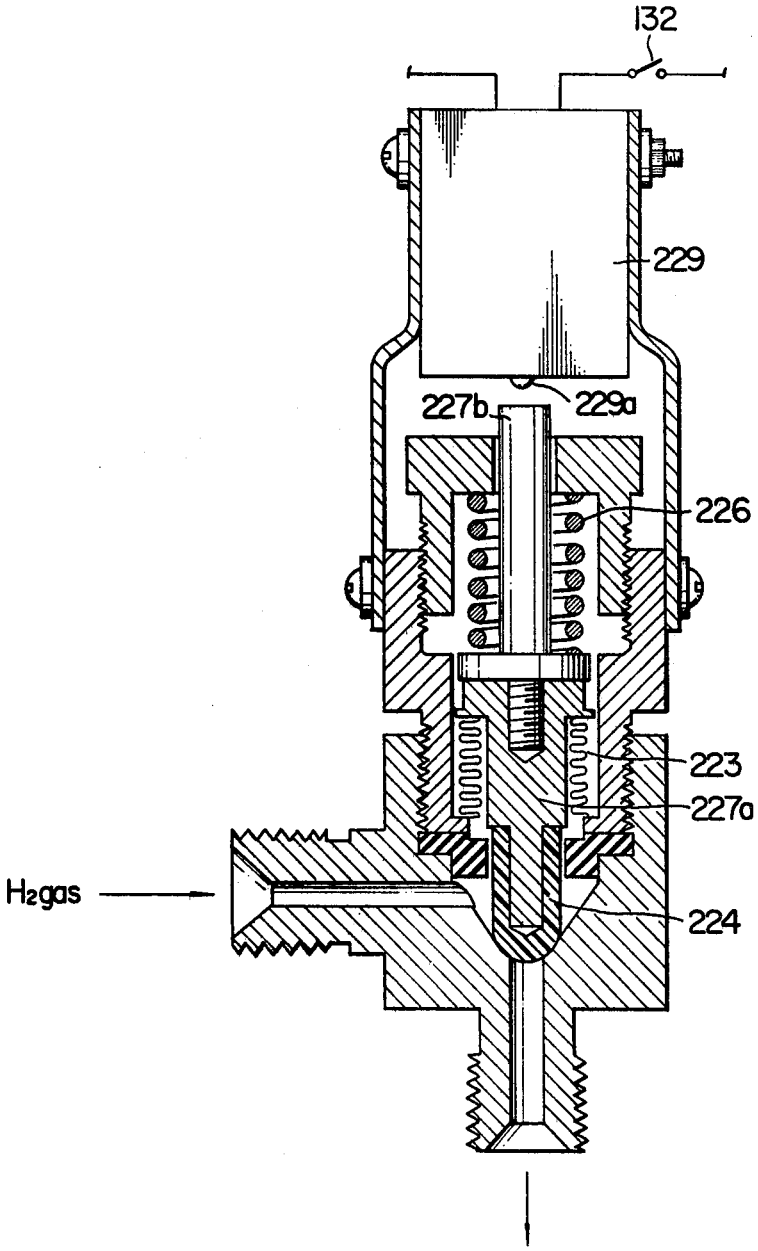
FIG. 19 is a modification thereof.

From the logical consequence that the pressure of the hydrogen gas drops with the turn-off of the power supply switch, the electromagnetic valve is not particularly necessary. The expansion and contraction of the bellows 223 which detects the hydrogen pressure, may directly operates a valve for the purpose. (See FIG. 19.) In this case, a spring 226 gives a valve closing force to the valve 224 and the valve seat is in the conical shape, and a shaft 227*b* which is connected to the top of the shaft 227*a* supporting the valve 224, comes into contact with the switch button 229a causing the micro-switch 229 to turn on and off. Although it is not shown in the figure the micro-switch 229 is connected in series with the power supply switch 131 and the power supply 132. When the pressure of the hydrogen gas being supplied exceeds a predetermined amount, the shaft 227 pushes the button 229a and turns off the switch 229 to stop producing hydrogen. A regulator 160 is positioned in front of the hydrogen gas valve to maintain the hydrogen at a constant pressure during the operation of the apparatus.

When the valve 112 is opened, the oxygen to be liberated at the anode 108 goes up the oxygen discharge passage in fine bubbles. A very small amount of organic matters are mixed in the electrolytic solution. These organic matters and the electrolytes such as caustic soda react together and form a very small amount of soap. By the action of the soap, the oxygen tends to form a large quantity of relatively large bubbles at the boundary surface of the electrolytic solution and the atmosphere in the oxygen discharge passage. These bubbles are led to the bubble vanishing chamber 161 and disappear completely when they are pushed out into the chamber as the sectional area at Sec. A—A in the FIG. 17 is larger than the sectional area of the inlet 162. The drops of water and the caustic soda (electrolytes) contained in the drops which have been forming the bubbles are returned through the return pipe 165 to the electrolytic solution tank 101, while the oxygen are released into the outer atmosphere through the release pipe 164. In this way, only oxygen are discharged into the outer atmosphere. This not only prevents the apparatus from being damaged by the bubbles containing caustic soda but eliminates the decrease in concentration of the caustic soda in the electrolytic solution. When the return pipe 165 is made relatively small in diameter and the bubble vanishing chamber 161 is made relatively small in volume, for example less than 200 cc, an explosive combustion that might be caused by the reaction of the oxygen and a small amount of hydrogen that is discharged together with the oxygen would not be a problem.

The hydrogen gas, on the other hand, permeats the cathode 5, and refines into a high pressure high purity hydrogen which is stored and compressed in the supply pipe 106. When the pressure of the hydrogen in the supply pipe 106 exceeds a predetermined pressure (which is preferably greater than the atmosperic pressure by more than 1 kg/cm$^2$, but may be a pressure slightly higher than the atmospheric pressure as long as that may cope against the pressure of the electrolytic solution) determined by the spring 226 and bellows 223 of the hydrogen gas valve, the valve 224 of the hydrogen gas valve unit opens so as to open the passage for the hydrogen gas to be fed to a device where it is required. And when the pressure of the hydrogen falls below the predetermined pressure, the valve 224 of the hydrogen gas valve unit closes and shuts off the supply pipe 106. The use of the bellows 223 for the detection of the hydrogen pressure enables the hydrogen gas valve to act sharply at the predetermined pressure. The control of the hydrogen pressure with hydrogen gas valve during the operation of the apparatus in this way prevents dislocation, deformation and breakage of the cathode 105. When the power supply switch 131 is turned off, breaking the circuit to the cathode 105 and anode 108 for stopping the operation of the apparatus, the electric current to the wire 127 stops and the coil spring 129 pushes back the valve 112 tightly against the end of the pipe 115, thereby closing the oxygen gas valve. With the turn-off of the switch 131, the hydrogen gas valve 122 is also closed. With the closing of the both valves, oxygen gas valve 112 and hydrogen gas valve 122, the cell inside the case plates 104 is kept under sealed condition.

Thus, the cathode 105, i.e., the palladium membranes, are kept being pressuring even after the cease of the operation, and therefore, the reinforcement 107 does not become detached from the palladium membranes and protects the palladium membranes from the possible damages. Also as described previously, upon closing the hydrogen gas valve 122, the hydrogen gas in the supply pipe 106 diffuses back through the cathode 105 into the electrolytic solution. For this, the oxygen gas in the electrolytic solution goes out into the atmosphere and there remains only a very little oxygen dissolved in the solution. The oxidation of the cathode during the cease is avoided in this way.

Figure 20:
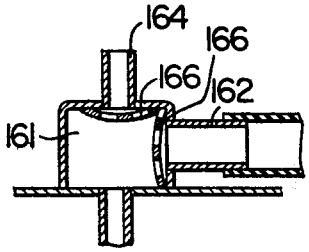
FIG. 20 through FIG. 22 are schematic views illustrating examples of the bubble vanishing chambers.
Figure 21:
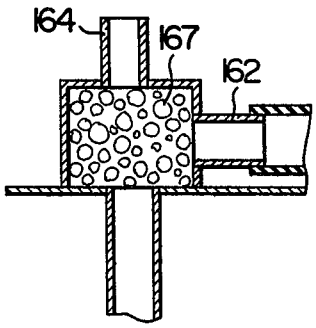
Figure 22:
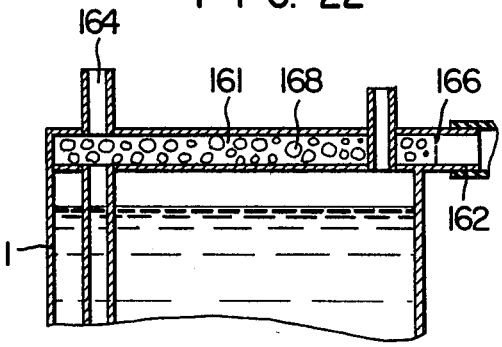

Further, it is a good and effective idea to provide the bubble vanishing chamber 161 with a net made of a material such as nickel, Teflon, or polyvinyl chloride as shown in FIG. 20 or to enclose fibers 167 such as ceramic fibers, nickel fibers, Teflon or polyvinyl chloride fibers as shown in FIG. 21. It will expedite vanishing of the bubbles and quickly extingish the flames in case the oxygen and hydrogen should accidentally react each other by shock. Also the bubble vanishing chamber may be made larger than 200 cc by providing grains 168 of alumina, nickel, Teflon, or P.V. C. in the chamber. With this, an efficient cooling of the bubbles containing oxygen and an effective recovery of the condensed solution can be made concurrently with the vanishing of bubbles and the avoidance of explosion.

What is claimed is:

1. A hydrogen generating apparatus for producing hydrogen gas by decomposing an electrolyte consisting mainly of water, comprising:

a. an electrolytic cell for containing the electrolyte, said cell having an anode and a cathode made of gas permeable palladium or palladium alloy;

b. an electric power source electrically connected across said anode and cathode for supplying electric power to said electrolytic cell through said anode and cathode to electrolyze the electrolyte therein;

c. a power supply switch for on-off control of the power supply from said power source to said electrolytic cell;

d. a discharge pipe connected to an outlet hole of said electrolytic cell for discharging oxygen gas produced at said anode;

e. a hydrogen chamber formed in the vicinity of said gas permeable cathode for collecting hydrogen gas electrolytically produced thereat;

f. a hydrogen supply pipe connected to said hydrogen chamber for supplying the hydrogen gas;

g. a hydrogen gas valve connected to said supply pipe, for closing the same to stop the supply of said hydrogen gas when said power supply switch is opened; and h. a valve unit connected to said discharge pipe, for closing said discharge pipe when a predetermined time has elapsed after the cessation of the power supply to said electrolytic cell so as to discharge a substantial amount of said oxygen gas through said discharge pipe during the predetermined elapsed time, and to prevent the hydrogen gas contained in said hydrogen chamber from discharging through the electrolyte and said discharge pipe.

2. An apparatus as claimed in claim 1 further comprising a storage tank connected to said discharge pipe for storing the electrolyte to be supplied to said electrolytic cell.

3. An apparatus as claimed in claim 1, wherein said hydrogen gas valve opens and closes said hydrogen supply pipe in response to the pressure of hydrogen gas in said supply pipe when said power supply switch is closed.

4. An apparatus as claimed in claim 1, wherein said hydrogen gas valve includes a second switch connected in series with said power supply switch for control of the power supply to said electrolytic cell in response to the pressure of the hydrogen when said power supply switch is closed.

5. An apparatus as claimed in claim 1, wherein said valve unit comprises:

a valve head cooperative with said outlet hole of said electrolytic cell at which outlet hole said discharge pipe is connected;

valve drive means having a thermal expansive material a shaft connected said valve head so as to drive said valve head in accordance with thermal expansion of said expansive material, and a heating wire connected to said power source through said power supply switch for heating said expansive material;

said valve head opening said outlet hole when said expansive material is expanded; and closing the same when said expansive material is contracted.

6. An apparatus as claimed in claim 1, wherein said valve unit opens said discharge pipe within 60 seconds after said power supply switch is closed.

7. An apparatus as claimed in claim 1, wherein said valve unit closes said discharge pipe within 5 to 10 minutes after said power supply switch is opened.

8. An apparatus as claimed in claim 1 further comprising:

a bubble trapping chamber connected to said discharge pipe for removing bubbles formed by the generated gas.

9. An apparatus as claimed in claim 8, wherein said bubble trapping chamber is provided with a net.

10. An apparatus as claimed in claim 8 wherein said bubble trapping chamber is filled with fibers.

11. An apparatus as claimed in claim 8, wherein the volume of said bubble trapping chamber is less than 200 cc.

12. An apparatus as claimed in claim 8, wherein said bubble trapping chamber is filled with grains of a material selected from the group consisting of alumina, nickel, Teflon and polyvinylchloride.

13. An apparatus as claimed in claim 1, wherein said electrolytic cell comprises;

an electrically conductive ring;

a pair of circular and flat membranes made of palladium or palladium alloy foring said cathode, said pair of membranes being disposed at both ends of said ring to form a cavity therebetween for containing said electrolyte;

insulating means disposed between said ring and said pair of membrane for electrically insulating said membranes from said ring; and a pair of plates disposed in said cavity and electrically connected to said ring to form said anode, each of said plates facing each of said flat membranes at a predetermined distance.

14. An apparatus as claimed in claim 13, further comprising a pair of dish-shaped case plates, each such plate being fixed to the outside of said membranes to form said hydrogen chamber.

15. An apparatus as claimed in claim 13, further comprising a reinforcement fixed to the inside surface of said membrane for reinforcing said membrane.

16. An apparatus as claimed in claim 15, wherein said reinforcement is in the form of a lattice-work.

17. An apparatus as claimed in claim 15, wherein said reinforcement is in the form of a net.

18. An apparatus as claimed in claim 13, wherein said anode plate is provided with a plurality of slanted holes.

19. A hydrogen generator for producing hydrogen gas by electrolyzing an electrolytic solution mainly consisting of water, comprising;

a. a ring having electric conductivity, b. a cylindrical body made up to two pieces of case plates having electric conductivity and placed, under electrically insulated condition, on the both ends of said ring, c. two pieces of cathode plate consisting of hydrogen permeative palladiumor palladium alloy membranes which are fixed to the inside surfaces of the case plates of said cylindrical body and are pinched in between and electrically insulated from said ring and form together with said ring the electrolytic cell to be filled with the electrolytic solution, d. two pieces of anode plate fastened to the surface of said ring and positioned in such a way that each plate faces said respective cathode plate, e. a power supply electrically connected to said ring and said case plates for impressing a voltage between said anode and cathode, f. a power supply switch for making and breaking said electrical connection with said anode and cathode, g. a discharge pipe joined to the top of said ring for discharging oxygen gas to be generated at said anode, h. an oxygen gas valve unit, for controlling the discharge of the oxygen gas, provided with a valve which is located at the opening of said discharge pipe to said electrolytic cell for sealing and opening of the electrolytic cell by opening and closing of said opening, and with a valve actuator which is connected to said valve for actuating said valve to open and close, and is operationally connected to said power supply switch to actuate said opening and closing in response to the on and off of said switch, i. a hydrogen chamber formed in the vicinity of said cathode for collecting the hydrogen gas to be liberated at the cathode and to be purified after its permeation of the cathode, j. a supply pipe connected to said hydrogen chamber for supplying said hydrogen gas, and k. a hydrogen gas valve installed to said supply pipe and is so arranged that it will open and close said supply pipe and will be closed when said supply switch is turned off, whereby said electrolytic cell and the hydrogen chamber are sealed while said hydrogen generator is not in operation.

20. An apparatus as set forth in claim 19, wherein the above-said anode plates are provided with many slanted holes for conducting the oxygen gas.

21. An apparatus as set forth in claim 20, wherein a reinforcement is provided between said cathode plates and said ring for reinforcing said cathode plates.

22. An apparatus as set forth in claim 21, wherein said reinforcement is in the form of a round lattice-work frame.

23. An apparatus as set forth in claim 21, wherein said reinforcement is in the form of a round net frame.

24. An apparatus as set forth in claim 22, wherein a part of said lattice-work is in contact with said anode plates keeping a space between said cathode and the anode substantially constant.

25. An apparatus as set forth in claim 19, wherein a storage tank, connected to said discharge pipe is further provided for both storing said electrolytic solution and supplying said solution from said tank to the electrolytic cell.

26. An apparatus as set forth in claim 25, wherein said electrolytic solution has a cap upon which a bubble trap chamber is provided for trapping the bubbles to be formed by oxygen gas.

27. An apparatus as set forth in claim 26, wherein said chamber is provided with a net.

28. An apparatus as set forth in claim 26, wherein said chamber is provided with granular particles.

29. An apparatus as set forth in claim 19, wherein said hydrogen gas valve is operationally connected to said power supply switch and is closed in response to the turn-off of said switch.

30. An apparatus as set forth in claim 19, wherein said hydrogen gas valve opens and closes in response to the pressure of hydrogen gas and is closed when the pressure of hydrogen gas becomes less than a predetermined pressure.

31. An apparatus as set forth in claim 30, wherein said hydrogen gas valve includes a second switch which is connected in series with said power supply switch and is turned off when the pressure of the hydrogen gas falls below a predetermined pressure, stopping said power supply from impressing the voltage to said anode.

32. An apparatus as set forth in claim 19 further comprises a delaying means is provided for making said oxygen gas valve unit close said oxygen gas valve after the lapse of a predetermined time from the turn-off of said power supply switch.

33. An apparatus as set forth in claim 19, wherein the valve actuator of said oxygen gas valve is provided with;

a. a thermal expansion means for expansion and contraction in response to the heat to be impressed, b. a connection means for connecting said thermal expansion means with said valve and for making said valve make a return motion in response to the expansion and contraction of said thermal expansion means, c. an additional switch which goes on and off with the return motion of said connection means, and is electrically connected in series with said power supply switch, and e. a means for supplying, in response to the on and off of the power supply and said second switch, the electric power to said electric heating means.

34. An apparatus as set forth in claim 19, wherein a cap is further placed on the top of said discharge pipe and a valve actuator for said oxygen gas valve is provided on the cap and is connected with said valve by a shaft disposed in said discharge pipe.

* * * * *

UNITED STATES PATENT AND TRADEMARK OFFICE

CERTIFICATE OF CORRECTION

PATENT NO. : 4,078,985

DATED : March 14, 1978

INVENTOR(S) : Yukihisa TAKEUCHI

It is certified that error appears in the above-identified patent and that said Letters Patent are hereby corrected as shown below:

Under the Heading:

Item [30] Foreign Application Priority Data

Please add:

July 23, 1976 Japan.... 51-99096

In the Drawings:

At top of each of the 9 sheets of drawing read the patent No. as "4,078,985"

Signed and Sealed this

*Twenty-eighth* Day of *November 1978*

[SEAL]

*Attest:*

RUTH C. MASON
*Attesting Officer*

DONALD W. BANNER
*Commissioner of Patents and Trademarks*